US007097953B2

(12) United States Patent
Ogawa et al.

(10) Patent No.: US 7,097,953 B2
(45) Date of Patent: Aug. 29, 2006

(54) PROCESS FOR PRODUCING ELECTROPHOTOGRAPHIC PHOTOSENSITIVE MEMBER, ELECTROPHOTOGRAPHIC PHOTOSENSITIVE MEMBER, PROCESS CARTRIDGE, AND ELECTROPHOTOGRAPHIC APPARATUS

(75) Inventors: Hideki Ogawa, Ibaraki (JP); Miyako Nagata, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 10/775,078

(22) Filed: Feb. 11, 2004

(65) Prior Publication Data

US 2004/0161691 A1 Aug. 19, 2004

(30) Foreign Application Priority Data

Feb. 13, 2003 (JP) ..... 2003-035230

(51) Int. Cl.
*G03G 5/00* (2006.01)

(52) U.S. Cl. ..... 430/127

(58) Field of Classification Search ..... 430/127
See application file for complete search history.

(56) References Cited

U.S. PATENT DOCUMENTS 3,741,643 A * 6/1973 Smith et al. ..... 399/249
5,362,588 A * 11/1994 Yoshihara et al. ..... 430/69
5,418,349 A * 5/1995 Swain et al. ..... 219/121.84
5,661,872 A * 9/1997 Meyer et al. ..... 15/309.2

FOREIGN PATENT DOCUMENTS

| | | |
|---|---|---|
| JP | 59-142555 | 8/1984 |
| JP | 61-168154 | 7/1986 |
| JP | 5-157847 | 6/1990 |
| JP | 2-51501 | 11/1990 |
| JP | 5-66586 | 3/1993 |

* cited by examiner

*Primary Examiner*—John L Goodrow
(74) *Attorney, Agent, or Firm*—Fitzpatrick, Cella, Harper & Scinto

(57) ABSTRACT

In a process for producing an electrophotographic photosensitive member having a support and a photosensitive layer provided thereon, the process comprises a coating step of coating the surface of the support with a coating fluid to form a wet coating; a drying step of drying the wet coating formed by the coating step, to form a dried coating film; a cutting step of making a cut in the dried coating film formed by the drying step, in its peripheral direction at a preset position; and a removal step of removing, by jetting a gas, the dried coating film on its end side extending from the cut made by the cutting step. Also disclosed are an electrophotographic photosensitive member produced by this production process, and a electrophotographic photosensitive member and an electrophotographic apparatus which have the electrophotographic photosensitive member.

5 Claims, 2 Drawing Sheets

PROCESS FOR PRODUCING ELECTROPHOTOGRAPHIC PHOTOSENSITIVE MEMBER, ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

This invention relates to a process for producing an electrophotographic photosensitive member, and also relates to an electrophotographic photosensitive member and a process cartridge and an electrophotographic apparatus which have the electrophotographic photosensitive member.

2. Related Background Art

As electrophotographic photosensitive members set in electrophotographic apparatus, inorganic electrophotographic photosensitive members making use of an inorganic photoconductive material such as selenium, cadmium sulfide or zinc oxide have conventionally been used. In recent years, however, organic electrophotographic photosensitive members making use of an organic photoconductive material have come to be widely used from the viewpoints of freeness from environmental pollution, high productivity, readiness for material designing, and so forth.

In general, the organic electrophotographic photosensitive member is so made up that a single layer or a plurality of layers (inclusive of a photosensitive layer) is/are formed on a support. These layers are formed by coating the support with coating fluids (solutions or dispersions) for the respective layers, followed by drying. Also, as the support, a cylindrical support is mostly used.

Members (such as spacers or rollers) for, e.g., keeping constant the distance between the electrophotographic photosensitive member (such as a photosensitive drum) and a developing member (such as a developing sleeve) (hereinafter "SD gap") are brought into contact with end portions of the electrophotographic photosensitive member, and hence it is necessary to remove the end portions of the layers (dried coating films) formed on the support.

As methods for removing the end portions of dried coating films, known are a method in which a metallic brush or resin brush impregnated with a solvent capable of dissolving the dried coating films is brought into contact with the end portions of dried coating films to remove them (Japanese Patent Publication No. H02-051501); a method in which the end portions of dried coating films are immersed in a solvent capable of dissolving the dried coating films and ultrasonic waves are applied thereto to remove them (Japanese Patent Application Laid-open No. S59-142555); a method in which a solvent capable of dissolving the dried coating films is sprayed from nozzles to the end portions of dried coating films to remove them (Japanese Patent Application Laid-open No. S61-168154); a method in which the end portions of dried coating films are abraded with a cutting tool, an abrasive wheel or the like to remove them (Japanese Patent Application Laid-open No. H02-157847); a method in which water jet is spouted to the end portions of dried coating films to remove them (Japanese Patent Application Laid-open No. H05-066586); and so forth.

However, in the case when the solvent is used, it may cause a swell of the layers, and also, after the solvent has been evaporated to dryness, it can not sufficiently be wiped off in some cases. Also, after it has been wiped off, the liquid may come to drip on the part from which the layers (dried coating films) have been removed. In the case when the brush is used, the support may come scratched at its part from which the layers (dried coating films) have been removed. In the case when the end portions are removed by a cutting tool, an abrasive wheel or the like, abrasive powder may adhere to the electrophotographic photosensitive member, or even necessary layers (dried coating films) may unwantedly be removed. In the case when water jet is spouted to remove the end portions, there are problems that a device for the removal is complicate and drops of water remain after the removal.

If, on the other hand, the end portions of dried coating films are not removed, the layers may come off because of the friction between the electrophotographic photosensitive member and the spacers, so that the SD gap may come non-uniform to cause non-uniformity in density of images reproduced. Also, the layers having come off may cause defects in images reproduced.

SUMMARY OF THE INVENTION

An object of the present invention is to solve the above problems, and provide a process for producing an electrophotographic photosensitive member in which process the end portion(s) of dried coating film(s) is/are removed by an efficient and inexpensive method.

Another object of the present invention is to provide an electrophotographic photosensitive member produced by the above process, and a process cartridge and an electrophotographic apparatus which have the electrophotographic photosensitive member.

That is, the present invention is a process for producing an electrophotographic photosensitive member having a support and a photosensitive layer provided thereon; the process comprising:

a coating step of coating the surface of the support with a coating fluid to form a wet coating;

a drying step of drying the wet coating formed by the coating step, to form a dried coating film;

a cutting step of making a cut in the dried coating film formed by the drying step, in its peripheral direction at a preset position; and a removal step of removing, by jetting a gas, the dried coating film on its end side extending from the cut made by the cutting step.

The present invention is also an electrophotographic photosensitive member characterized by being produced by the above production process.

The present invention is still also a process cartridge comprising the above electrophotographic photosensitive member and at least one means selected from the group consisting of a charging means, a developing means, transfer means and a cleaning means which are integrally supported, and being detachably mountable to the main body of an electrophotographic apparatus.

The present invention is further an electrophotographic apparatus comprising the above electrophotographic photosensitive member, a charging means, an exposure means, a developing means and a transfer means.

DESCRIPTION OF THE PREFERRED EMBODIMENTS

The present invention is described below in detail.

The electrophotographic photosensitive member of the present invention is an electrophotographic photosensitive member having a support and a photosensitive layer provided thereon.

The photosensitive layer may be either of a single-layer type photosensitive layer which contains a charge-transporting material and a charge-generating material in the same layer and a multi-layer type (function-separated type) photosensitive layer which is separated into a charge generation layer containing a charge-generating material and a charge transport layer containing a charge-transporting material.

A conductive layer intended for the prevention of interference fringes caused by scattering of laser light or the like or for the covering of scratches of the support surface and an intermediate layer having the function as a barrier and the function of adhesion may also be provided between the support and the photosensitive layer.

A part or all of the respective layers is/are formed at least through a coating step of coating a coating fluid for each layer to form a wet coating, and a drying step of drying the wet coating formed by the coating step, to form a dried coating film.

As to the part or all of the respective layers, the step(s) of forming the layer(s) further has/have a cutting step of making a cut in the dried coating film in its peripheral direction at a preset position, and a removal step of removing, by jetting a gas, the dried coating film on its end side extending from the cut.

Incidentally, in the present invention, the dried coating film includes coating films having hardened upon drying as in a case in which a thermoplastic resin is used as a binder resin of the layer, and coating films not only having dried but also having cured (e.g.,three-dimensionally cross-linked) as in a case in which a curable resin is used as a binder resin of the layer.

In the present invention, the portion of the dried coating film on its end side extending from the cut is herein called an end portion of the dried coating film.

The removal of the end portion of the dried coating film may be carried out on only one end portion, or may be carried out on both end portions. The removal of the end portion of the dried coating film may also be carried out on only some layer(s) among the respective layers formed on the support, or may be carried out on all the layers. Also, where the removal of the end portion of the dried coating film is carried out on a plurality of layers, the end portion may be removed every time the dried coating film of each layer has been formed, or, after some dried coating films have been formed in order, their ends may be removed at a time. The latter is more efficient.

The gas used in gas jetting may include air and nitrogen gas. Air is preferred from the viewpoint of simplicity and easiness. The air may also preferably directly be jetted to the cut made in the cutting step.

Figure 1:
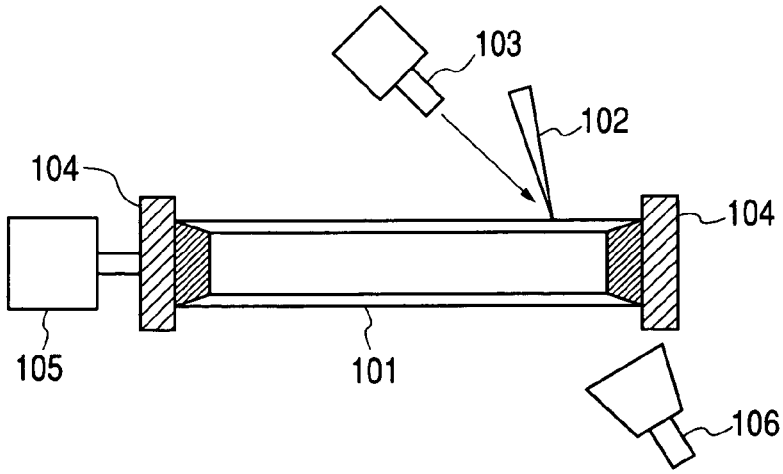
FIG. 1 is a schematic view showing an example of the construction of an apparatus for removing the end portion(s) of dried coating film(s) (a dried coating film end portion remover).

FIG. 1 schematically illustrates an example of the construction of an apparatus for removing the end portion(s) of dried coating film(s) (a dried coating film end portion remover). In FIG. 1, reference numeral 101 denotes a workpiece (an electrophotographic photosensitive member on which the dried coating film(s) has/have been formed on a support and the end portion(s) of the dried coating film(s) has/have not been removed); 102, a cutter; 103, an air nozzle; 104, chucking fixtures; 105, a workpiece-rotating motor; and 106, a dust collector.

The chucking fixtures 104 are inserted to the both ends of the workpiece 101 to fix the workpiece 101, and the workpiece 101 is rotated by means of the workpiece-rotating motor 105. Next, a cut is made by the cutter 102 in the dried coating film(s) in its/their peripheral direction at a preset position. Thereafter, air is jetted out of the air nozzle 103 to remove the dried coating film(s) on its/their end side extending from the cut (an end portion of the dried coating film(s)). The end portion removed is collected in the dust collector 106.

Figure 2:
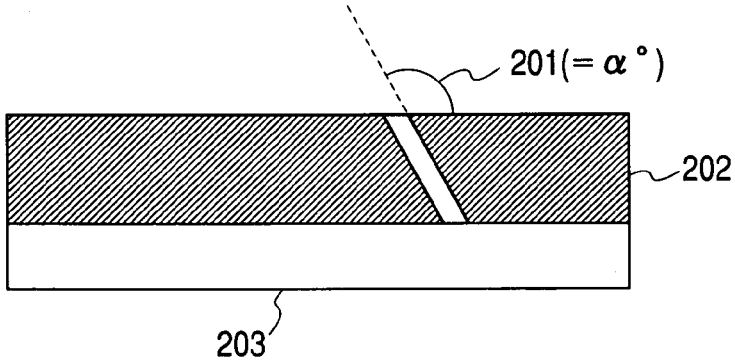
FIG. 2 is a view showing an example of the axial section of an end portion of an electrophotographic photosensitive member.

FIG. 2 illustrates an example of the axial section of an end portion of the electrophotographic photosensitive member of the present invention. In FIG. 2, reference numeral 201 denotes an angle formed between the direction of cutting and the surface of the dried coating film to be removed, of the dried coating film(s); 202, the dried coating film to be removed; and 203, a support.

An angle $\alpha°$ formed between the direction of cutting and the surface of the dried coating film to be removed, of the dried coating film(s) may preferably be 90° or more, and may particularly more preferably be 95° or more. If it is less than 90°, it may take a long time to remove the end portion of the dried coating film(s), or lifting may occur in the dried coating film(s) on the side not to be removed.

Figure 3:
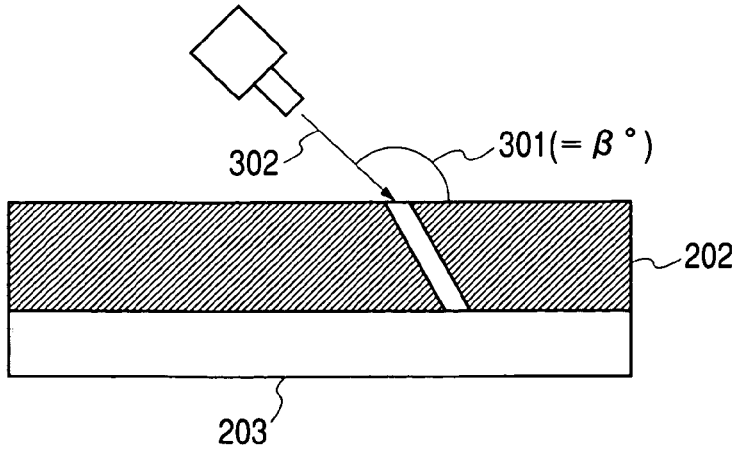
FIG. 3 is a view showing an example of the axial section of an end portion of an electrophotographic photosensitive member.

FIG. 3 illustrates an example of the axial section of an end portion of the electrophotographic photosensitive member of the present invention. In FIG. 3, reference numeral 301 denotes an angle formed between the direction of gas jetting and the surface of the dried coating film to be removed, of the dried coating film(s); 202, the dried coating film to be removed; 203, a support; and 30, the direction of gas jetting.

An angle $\beta°$ formed between the direction of gas jetting and the surface of the dried coating film to be removed, of the dried coating film(s) may preferably be 90° or more, and may particularly more preferably be 100° or more. If it is less than 90°, it may take a long time to remove the end portion of the dried coating film(s), or lifting may occur in the dried coating film(s) on the side not to be removed.

In addition, the angle $\alpha°$ formed between the direction of cutting and the surface of the dried coating film to be removed, of the dried coating film(s) and the angle $\beta°$ formed between the direction of gas jetting and the surface of the dried coating film to be removed, of the dried coating film(s) may preferably satisfy the relationship of $\alpha-10 \leqq \beta \leqq \alpha+80$, and may particularly more preferably satisfy the relationship of $\alpha \leqq \beta \leqq \alpha+60$.

Incidentally, either of the angle $\alpha°$ and the angle $\beta°$ is less than 180°.

The electrophotographic photosensitive member of the present invention is constructed as described below.

The photosensitive layer may be, as mentioned above, either of the single-layer type photosensitive layer and the multi-layer type (function-separated type) photosensitive layer. From the viewpoint of electrophotographic performance, the multi-layer type photosensitive layer is preferred. The multi-layer type photosensitive layer may also include a regular-layer type photosensitive layer in which the charge generation layer and the charge transport layer are superposed in this order from the support side and a reverse-layer type photosensitive layer in which the charge transport layer and the charge generation layer are superposed in this order from the support side. From the viewpoint of electrophotographic performance, the regular-layer type photosensitive layer is preferred.

As the support, it may be one having conductivity (conductive support). For example, usable are supports made of a metal such as aluminum, aluminum alloy or stainless steel. Also usable are the above supports made of a metal, or supports made of a plastic, and having layers film-formed by vacuum deposition of aluminum, aluminum alloy, indium oxide-tin oxide alloy or the like. Still also usable are supports comprising plastic or paper impregnated with conductive fine particles (e.g., carbon black, tin oxide particles, titanium oxide particles or silver particles) together with a suitable binder resin, and supports made of a plastic containing a conductive binder resin. Also, as the shape of the support, it may include cylindrical and beltlike. In the present invention, a cylindrical support is preferred.

As mentioned above, the conductive layer intended for the prevention of interference fringes caused by scattering of laser light or the like or for the covering of scratches of the support surface may be provided between the support and the photosensitive layer or the intermediate layer. The conductive layer may be formed by coating the support with a dispersion prepared by dispersing conductive particles such as carbon black or metal particles in a binder resin. The conductive layer may preferably be in a layer thickness of from 0.1 μm to 30 μm, and particularly more preferably from 0.5 μm to 20 μm.

In place of providing the conductive layer, also for the purpose of prevention of interference fringes caused by scattering of laser light or the like, the surface of the support may be subjected to cutting treatment, surface roughening treatment or anodizing treatment.

The intermediate layer having the function as a barrier and the function of adhesion may also be provided between the support or the conductive layer and the photosensitive layer. The intermediate layer is formed for the purposes of, e.g., improving the adhesion of the photosensitive layer, improving coating performance, improving the injection of electric charges from the support and protecting the photosensitive layer from any electrical breakdown. The intermediate layer may be formed using a material such as casein, polyvinyl alcohol resin, ethyl cellulose resin, an ethylene-acrylic acid copolymer, polyamide resin, modified polyamide resin, polyurethane resin, gelatin resin or aluminum oxide. The intermediate layer may preferably be in a layer thickness of 0.05 μm to 5 μm, and particularly more preferably from 0.3 μm to 1.5 μm.

The charge-generating material used in the electrophotographic photosensitive member of the present invention may include, e.g., azo pigments such as monoazo, disazo and trisazo, phthalocyanine pigments such as metal phthalocyanines and metal-free phthalocyanine, indigo pigments such as indigo and thioindigo, perylene pigments such as perylene acid anhydrides and perylene acid imides, polycyclic quinone pigments such as anthraquinone and pyrenequinone, squarilium dyes, pyrylium salts and thiapyrylium salts, triphenylmethane dyes, inorganic materials such as selenium, selenium-tellurium and amorphous silicon, quinacridone pigments, azulenium salt pigments, cyanine dyes, xanthene dyes, quinoneimine dyes, styryl dyes, cadmium sulfide, and zinc oxide. Any of these charge-generating materials may be used alone or in combination of two or more.

In the case when the photosensitive layer is the multilayer type photosensitive layer, the binder resin used to form the charge generation layer may include, e.g., polycarbonate resins, polyester resins, polyarylate resins, butyral resins, polystyrene resins, polyvinyl acetal resins, diallyl phthalate resins, acrylic resins, methacrylic resins, vinyl acetate resins, phenolic resins, silicone resins, polysulfone resins, styrene-butadiene copolymer resins, alkyd resins, epoxy resins, urea resins, and vinyl chloride-vinyl acetate copolymer resins. In particular, butyral resins and so forth are preferred. Any of these may be used alone or in the form of a mixture or copolymer of two or more types.

The charge generation layer may be formed by coating a charge generation layer coating fluid obtained by dispersing the charge-generating material in the binder resin together with a solvent, followed by drying. As a method for dispersion, a method is available which makes use of a homogenizer, an ultrasonic dispersion machine, a ball mill, a sand mill, a roll mill, a vibration mill, an attritor or a liquid impact type high-speed dispersion machine. The charge-generating material and the binder resin may preferably be in a proportion ranging from 1:0.3 to 1:4 (weight ratio).

As the solvent used for the charge generation layer coating dispersion, it may be selected taking account of the binder resin to be used and the solubility or dispersion stability of the charge-generating material. As an organic solvent, usable are alcohols, sulfoxides, ketones, ethers, esters, aliphatic halogenated hydrocarbons, aromatic compounds and so forth.

The charge generation layer may preferably be in a layer thickness of 5 μm or less, and particularly more preferably from 0.1 μm to 2 μm.

To the charge generation layer, a sensitizer, an antioxidant, an ultraviolet absorber and a plasticizer which may be of various types may also optionally be added.

The charge-transporting material used in the electrophotographic photosensitive member of the present invention may include, e.g., triarylamine compounds, hydrazone compounds, styryl compounds, stilbene compounds, pyrazoline compounds, oxazole compounds, thiazole compounds, and triarylmethane compounds. Any of these charge-transporting materials may be used alone or in combination of two or more.

In the case when the photosensitive layer is the multilayer type photosensitive layer, the binder resin used to form the charge transport layer may, include, e.g., acrylic resins, methacrylic resins, polyacrylamide resins, acrylonitrile resins, polyamide resins, polyvinyl butyral resins, vinyl chloride resins, vinyl acetate resins, phenoxy resins, phenolic resins, polystyrene resins, polyester resins, polycarbonate resins, polyarylate resins, polysulfone resins, polyphenylene oxide resins, epoxy resins, polyurethane resins, alkyd resins and unsaturated resins. In particular, polycarbonate resins, polyarylate resins and so forth are preferred. Any of these may be used alone or in the form of a mixture or copolymer of two or more types.

The charge transport layer may be formed by coating a charge transport layer coating solution prepared by dissolving the charge-transporting material and binder resin in a solvent, followed by drying. The charge-transporting material and the binder resin may preferably be in a proportion ranging from 5:1 to 1:5 (weight ratio), and more preferably from 3:1 to 1:3 (weight ratio).

As the solvent used in the charge transport layer coating solution, usable are ketones such as acetone and methyl ethyl ketone, esters such as methyl acetate and ethyl acetate, aromatic hydrocarbons such as toluene and xylene, ethers such as 1,4-dioxance and tetrahydrofuran, and hydrocarbons substituted with a halogen atom, such as chlorobenzene, chloroform and carbon tetrachloride.

When the charge transport layer coating solution is coated, coating methods as exemplified by dip coating, spray coating, spinner coating, roller coating, Mayer bar coating and blade coating may be used.

An organic photoconductive polymer such as poly-N-vinyl carbazole, polyvinyl anthracene or polyvinyl pyrene may also be used as the charge transporting material.

The charge transport layer may preferably be in a layer thickness of from 5 μm to 50 μm, and particularly more preferably from 10 μm to 30 μm.

In the case when the photosensitive layer is the single-layer type photosensitive layer, the single-layer type photosensitive layer may be formed by coating a single-layer type photosensitive layer coating dispersion obtained by dispersing the charge-generating material and charge-transporting material in the binder resin together with the solvent, followed by drying.

A protective layer intended for the protection of the photosensitive layer may also be provided on the photosensitive layer. The protective layer may be formed by coating a protective layer coating solution obtained by dissolving any of the above various binder resins in a solvent, followed by drying.

The protective layer may preferably be in a layer thickness of from 0.5 μm to 10 μm, and particularly preferably from 1 μm to 5 μm.

When the coating solutions for the above various layers are coated, coating methods as exemplified by dip coating, spray coating, spinner coating, roller coating, Mayer bar coating and blade coating may be used.

Figure 4:
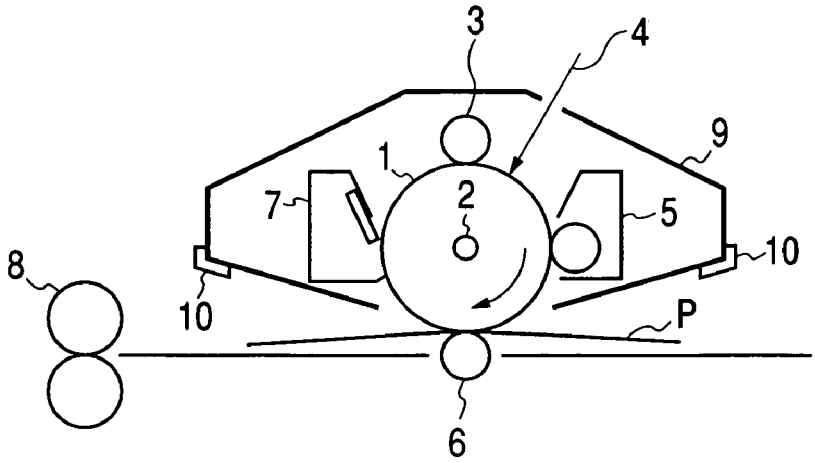
FIG. 4 is a schematic view showing an example of the construction of an electrophotographic apparatus having a process cartridge.

FIG. 4 schematically illustrates the construction of an electrophotographic apparatus having a process cartridge.

In FIG. 4, reference numeral 1 denotes a cylindrical electrophotographic photosensitive member, which is rotatingly driven around an axis 2 in the direction of an arrow at a stated peripheral speed.

The surface of the electrophotographic photosensitive member 1 rotatingly driven is uniformly electrostatically charged to a positive or negative, given potential through a charging means (primary charging means such as a charging roller) 3. The electrophotographic photosensitive member thus charged is then exposed to exposure light (imagewise exposure light) 4 emitted from an exposure means (not shown) for slit exposure, laser beam scanning exposure or the like. In this way, electrostatic latent images corresponding to the intended image are successively formed on the surface of the electrophotographic photosensitive member 1.

The electrostatic latent images thus formed on the surface of the electrophotographic photosensitive member 1 are developed with a toner contained in a developer a developing means 5 has, to form toner images. Then, the toner images thus formed and held on the surface of the electrophotographic photosensitive member 1 are successively transferred by applying a transfer bias from a transfer means 6, which are transferred on to a transfer material (such as paper) P fed from a transfer material feed means (not shown) to the part (contact zone) between the electrophotographic photosensitive member 1 and the transfer means 6 in the manner synchronized with the rotation of the electrophotographic photosensitive member 1.

The transfer material P to which the toner images have been transferred is separated from the surface of the electrophotographic photosensitive member 1, is led through a fixing means 8, where the toner images are fixed, and is then put out of the apparatus as an image-formed material (a print or copy).

The surface of the electrophotographic photosensitive member 1 from which toner images have been transferred is brought to removal of the developer (toner) remaining after the transfer, through a cleaning means (such as a cleaning blade) 7. Thus, its surface is cleaned. It is further subjected to charge elimination by pre-exposure light (not shown) emitted from a pre-exposure means (not shown), and thereafter repeatedly used for the formation of images. Incidentally, where as shown in FIG. 4 the primary charging means 3 is a contact charging means making use of a charging roller or the like, the pre-exposure is not necessarily required.

The apparatus may be constituted of a combination of plural components integrally joined in a container as a process cartridge from among the constituents such as the above electrophotographic photosensitive member 1, charging means 3, developing means 5, transfer means 6 and cleaning means 7 so that the process cartridge is set detachably mountable to the main body of an electrophotographic apparatus such as a copying machine or a laser beam printer. In the apparatus shown in FIG. 4, the electrophotographic photosensitive member 1 and the charging means 3, developing means 5 and cleaning means 7 are integrally supported to form a process cartridge 9 that is detachably mountable to the main body of the apparatus through a guide means 10 such as rails provided in the main body of the electrophotographic apparatus.

Figure 5:
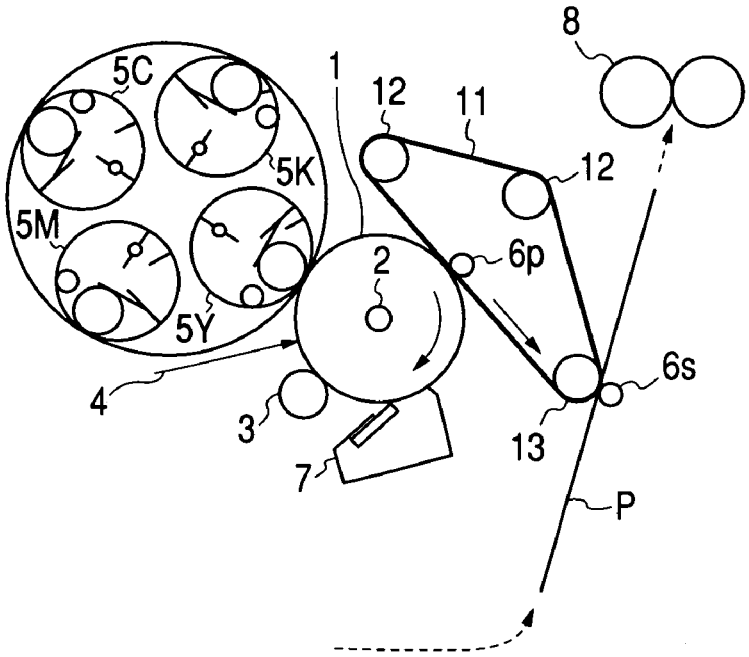
FIG. 5 is a schematic view showing an example of the construction of a color electrophotographic apparatus of an intermediate transfer system.

FIG. 5 schematically illustrates the construction of a color electrophotographic apparatus of an intermediate transfer system. In the case of the intermediate transfer system, its transfer means is chiefly constituted of a primary transfer member, an intermediate transfer member and a secondary transfer member.

In FIG. 5, reference numeral 1 denotes a cylindrical electrophotographic photosensitive member, which is rotatingly driven around an axis 2 in the direction of an arrow at a stated peripheral speed.

The surface of the electrophotographic photosensitive member 1 rotatingly driven is uniformly electrostatically charged to a positive or negative, given potential through a charging means (primary charging means such as a charging roller) 3. The electrophotographic photosensitive member thus charged is then exposed to exposure light (imagewise exposure light) 4 emitted from an exposure means (not shown) for slit exposure, laser beam scanning exposure or the like. Here, the exposure light is exposure light corresponding to a first-color component image (e.g., a yellow component image) of an intended color image. In this way, first-color component electrostatic latent images (yellow component electrostatic latent images) corresponding to the first-color component image of the intended color image are successively formed on the surface of the electrophotographic photosensitive member 1.

An intermediate transfer member (intermediate transfer belt) stretched over stretch rollers 12 and a secondary transfer opposing roller 13 is rotatingly driven in the direction of an arrow at substantially the same peripheral speed as the electrophotographic photosensitive member 1 (e.g., 97% to 103% in respect to the peripheral speed of the electrophotographic photosensitive member 1).

The first-color component electrostatic latent images thus formed on the surface of the electrophotographic photosensitive member 1 are developed with a first-color toner (yellow toner) contained in a developer a first-color developing means (yellow developing means) 5Y has, to form first-color toner images (yellow toner images). Then, the first-color toner images thus formed and held on the surface of the electrophotographic photosensitive member 1 are successively primarily transferred by applying a transfer bias from a primary transfer means 6*p*, which are transferred on to the surface of the intermediate transfer member 11 which passes the part between the electrophotographic photosensitive member 1 and the primary transfer means (primary transfer roller) 6*p*.

The surface of the electrophotographic photosensitive member 1 from which the first-color toner images have been transferred is brought to removal of the developer (toner) remaining after the primary transfer, through a cleaning means 7. Thus, the surface is cleaned, and thereafter the electrophotographic photosensitive member 1 is used for the formation of a next-color image.

Second-color toner images (magenta toner images), third-color toner images (cyan toner images) and fourth-color toner images (black toner images) are also formed on the surface of the electrophotographic photosensitive member 1 in the same manner as the first-color toner images, and transferred to the surface of the intermediate transfer member 11 in order. In this way, synthesized toner images corresponding to the intended color image are formed on the surface of the intermediate transfer member 11. During the primary transfer of the first-color to fourth-color toners, a secondary transfer member (secondary transfer roller) 6*s* is kept apart from the surface of the intermediate transfer member 11.

The synthesized toner images formed on the surface of the intermediate transfer member are successively secondarily transferred by applying a secondary transfer bias from the secondary transfer means 6*s*, which are transferred on to a transfer material (such as paper) P fed from a transfer material feed means (not shown) to the part (contact zone) between the intermediate transfer member 11 (at its part of the secondary transfer opposing roller 13) and the secondary transfer means 6*s* in the manner synchronized with the rotation of the intermediate transfer member 11.

The transfer material P to which the synthesized toner images have been transferred is separated from the surface of the intermediate transfer member 11, is led through a fixing means 8, where the toner images are fixed, and is then put out of the apparatus as a color-image-formed material (a print or copy).

The surface of the electrophotographic photosensitive member 1 from which the transfer residual developers (toners) have been removed by a cleaning means 7 may be subjected to charge elimination by pre-exposure light emitted from a pre-exposure means. Where as shown in FIG. 5 the charging means 3 is a contact charging means making use of a charging roller or the like, the pre-exposure is not necessarily required.

In the color electrophotographic apparatus constructed as shown in FIG. 5 as well, like the electrophotographic apparatus constructed as shown in FIG. 4, the apparatus may be constituted of a combination of plural components integrally joined in a container as a process cartridge from among the constituents such as the above electrophotographic photosensitive member, charging means, developing means, transfer means and cleaning means so that the process cartridge is set detachably mountable to the main body of an electrophotographic apparatus such as a copying machine or a laser beam printer.

EXAMPLES

The present invention is described below in greater detail by giving Examples. The present invention, however, is by no means limited to these Examples. In the following Examples, "part(s)" refers to "part(s) by weight".

Example 1

An aluminum cylinder of 62 mm in diameter and 363 mm in length was used as a support.

First, 10 parts of $SnO_2$-coated barium sulfate (conductive pigment), 2 parts of titanium oxide (resistance-modifying pigment), 6 parts of phenol resin, 0.001 part of silicone oil (leveling agent) and a mixed solvent of 4 parts of methanol and 16 parts of methoxypropanol were subjected to dispersion for 2 hours by means of a sand mill making use of glass beads of 1 mm in diameter, to prepare a conductive layer coating dispersion.

This conductive layer coating dispersion was dip-coated on the support, followed by heat-curing at 140° C. for 30 minutes to form a conductive layer with a layer thickness of 15 μm.

Next, 3 parts of N-methoxymethylated nylon and 3 parts of copolymer nylon were dissolved in a mixed solvent of 65 parts of methanol and 30 parts of n-butanol to prepare an intermediate layer coating solution.

This intermediate layer coating solution was dip-coated on the conductive layer, followed by drying at 80° C. for 10 minutes to form an intermediate layer with a layer thickness of 0.5 μm.

Next, 4 parts of an azo pigment (charge-generating material) having a structure represented by the following formula:

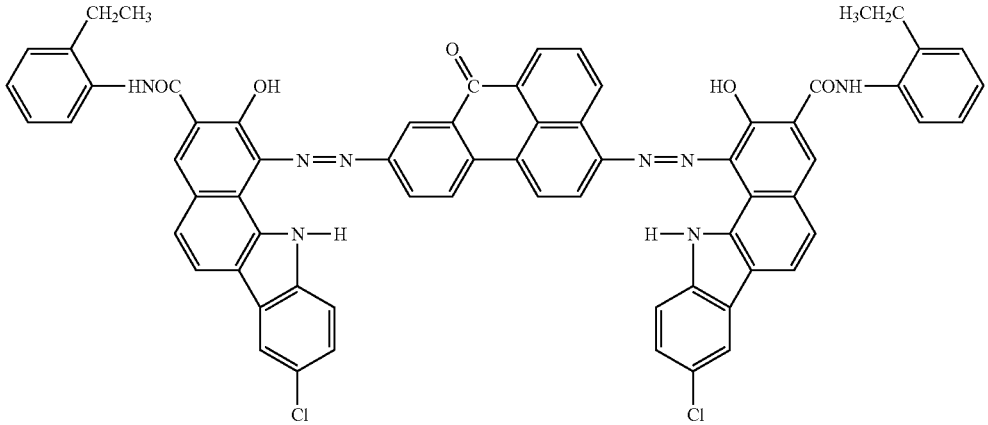

2 parts of polyvinyl butyral resin (trade name: S-LEC BLS, available from Sekisui Chemical Co., Ltd.) and 35 parts of cyclohexanone were subjected to dispersion for 12 hours by means of a sand mill making use of glass beads of 1 mm in diameter, and then 60 parts of methyl ethyl ketone was added to prepare a charge generation layer coating dispersion.

This charge generation layer coating dispersion was dip-coated on the intermediate layer, followed by drying at 80° C. for 10 minutes to form a charge generation layer with a layer thickness of 0.3 μm.

Next, 7 parts of an amine compound having a structure represented by the following formula:

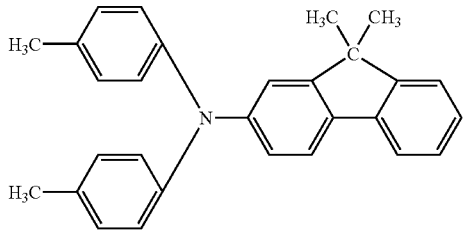

1 part of an amine compound having a structure represented by the following formula:

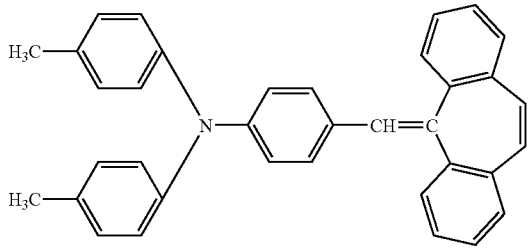

and 10 parts of polycarbonate resin (trade name: IUPILON Z-200; available from Mitsubishi Gas Chemical Company, Inc.) were dissolved in 80 parts of chlorobenzene to prepare a charge transport layer coating solution.

This charge transport layer coating solution was dip-coated on the charge generation layer, followed by, drying at 120° C. for 1 hour to form a charge transport layer (dried coating film) with a layer thickness of 30 μm.

Incidentally, the above respective layers were all started being coated from a position of 5 mm from the upper end of the aluminum cylinder (support).

In respect of the electrophotographic photosensitive member thus produced (before end portion removal), the charge transport layer was removed at its both end portions by 15 mm each by means of the dried coating film end portion remover constructed as shown in FIG. 1. Conditions for the removal were as follows:

Number of revolutions of electrophotographic photosensitive member (from the start of the removal of an end portion to the finish of the removal of the end portion): 100 rpm.

Cutter: A circular cutter of 18 mm in diameter and 0.3 mm in blade thickness.

Contact pressure of cutter against charge transport layer: 500 gf (4.9 N).

Cutting angle (angle α°): 95°.

Cutting time: 2 seconds.

Air pressure: 5 kgf/cm$^2$ (49 N/cm$^2$).

Distance between air nozzle tip and cutting position: 20 mm.

Air jet angle (angleβ°): 135°.

Air jet time: 3 seconds.

The both end portions of the electrophotographic photosensitive member thus produced (after end portion removal) were visually observed to find that the charge transport layer had completely been removed (not meaning that the layer beneath the charge transport layer remained completely).

The electrophotographic photosensitive member thus produced was set in a remodeled machine of a copying machine manufactured by CANON INC., CP660 (having a developing sleeve). In remodeling it, spacers (having no bearing) of 2 mm in width were used as spacers for keeping the SD gap constant. These were brought into contact with regions of 10 mm to 12 mm each from the both ends of the electrophotographic photosensitive member, and were so adjusted that the SD gap was 450 μm. Also, as a developer, a two-component developer was used which was prepared by blending a toner produced by polymerization and having an average circularity of 0.960 and a weight-average particle diameter of 7 μm and a magnetic carrier in a toner concentration of 8%.

In an environment of 23° C./50% RH, a full-color image with a print percentage of 6% was reproduced on 10,000 sheets in an intermittent mode in which copying was stopped once for each copying on one sheet of A4-size plain paper. Images reproduced at the initial stage and after-copying on 10,000 sheets were evaluated.

The results are shown in Table 1

Example 2

An electrophotographic photosensitive member was produced in the same manner as in Example 1 except that, in removing the end portions of the charge transport layer therein, the cutting angle was changed to 90°. Evaluation was made in the same way. The results are shown in Table 1.

Example 3

An electrophotographic photosensitive member was produced in the same manner as in Example 1 except that, in removing the end portions of the charge transport layer therein, the cutting angle was changed to 90° and the air jet time was changed to 5 seconds. Evaluation was made in the same way. The results are shown in Table 1.

Example 4

An electrophotographic photosensitive member was produced in the same manner as in Example 1 except that, in removing the end portions of the charge transport layer therein, the cutting angle was changed to 90° and the air jet angle was changed to 90°. Evaluation was made in the same way. The results are shown in Table 1.

Example 5

An electrophotographic photosensitive member was produced in the same manner as in Example 1 except that, in removing the end portions of the charge transport layer therein, the cutting angle was changed to 85°. Evaluation was made in the same way. The results are shown in Table 1.

The both end portions of the electrophotographic photosensitive member thus produced (after end portion removal) were visually observed to find that the charge transport layer had completely been removed, but lifting was slightly seen at some part of non-image formation areas in regard to the charge transport layer on the side not to be removed (no influence on images reproduced).

Example 6

An electrophotographic photosensitive member was produced in the same manner as in Example 1 except that, in removing the end portions of the charge transport layer therein, the air jet angle was changed to 90°. Evaluation was made in the same way. The results are shown in Table 1.

The both end portions of the electrophotographic photosensitive member thus produced (after end portion removal) were visually observed to find that the charge transport layer had completely been removed, but lifting was slightly seen at some part of non-image formation areas in regard to the charge transport layer on the side not to be removed (no influence on images reproduced).

Example 7

An electrophotographic photosensitive member was produced in the same manner as in Example 1 except that, in removing the end portions of the charge transport layer therein, the air jet angle was changed to 85°. Evaluation was made in the same-way. The results are shown in Table 1.

The both end portions of the electrophotographic photosensitive member thus produced (after end portion removal) were visually observed to find that the charge transport layer had completely been removed, but lifting was slightly seen at some part of non-image formation areas in regard to the charge transport layer on the side not to be removed (no influence on images reproduced).

Comparative Example 1

An electrophotographic photosensitive member was produced in the same manner as in Example 1 except that the end portions of the charge transport layer were not removed therein. Evaluation was made in the same way. The results are shown in Table 1.

Comparative Example 2

An electrophotographic photosensitive member was produced in the same manner as in Example 1 except that, in removing the end portions of the charge transport layer therein, a method was employed in which an abrasive wheel was brought into touch with each end portion of the charge transport layer to carry out abrasion. Evaluation was made in the same way. The results are shown in Table 1.

Comparative Example 3

An electrophotographic photosensitive member was produced in the same manner as in Example 1 except that, in removing the end portions of the charge transport layer therein, a method was employed in which a metallic brush impregnated with a solvent (monochlorobenzene) capable of dissolving the charge transport layer was brought into contact with each end portion of the charge transport layer to remove the end portions. Evaluation was made in the same way. The results are shown in Table 1.

Comparative Example 4

An electrophotographic photosensitive member was produced in the same manner as in Example 1 except that, in removing the end portions of the charge transport layer therein, a method was employed in which each end portion of the charge transport layer was immersed in a solvent (monochlorobenzene) capable of dissolving the charge transport layer and ultrasonic waves were applied to remove the end portions. Evaluation was made in the same way. The results are shown in Table 1.

Comparative Example 5

An electrophotographic photosensitive member was produced in the same manner as in Example 1 except that, in removing the end portions of the charge transport layer therein, a method was employed in which a solvent (monochlorobenzene) capable of dissolving the charge transport layer was sprayed to each end portion of the charge transport layer to remove the end portions. Evaluation was made in the same way. The results are shown in Table 1.

Comparative Example 6

An electrophotographic photosensitive member was produced in the same manner as in Example 1 except that, in removing the end portions of the charge transport layer therein, a method was employed in which a water jet was sprayed to each end portion of the charge transport layer to remove the end portions. Evaluation was made in the same way. The results are shown in Table 1.

TABLE 1

| | Both end portions of electrophotographic photosensitive member | Reproduced-image evaluation | |
|---|---|---|---|
| | (after end portion removal) | Initial stage | After 10,000 sheets |
| Example: | | | |
| 1 | Charge transport layer was completely removable. | Good. | Good. |
| 2 | Charge transport layer was completely removable. | Good. | Good. |
| 3 | Charge transport layer was completely removable. | Good. | Good. |
| 4 | Charge transport layer was completely removable. | Good. | Good. |

TABLE 1-continued

| | Both end portions of electrophotographic photosensitive member (after end portion removal) | Reproduced-image evaluation | |
|---|---|---|---|
| | | Initial stage | After 10,000 sheets |
| 5 | Charge transport layer was completely removable. | Good. | Good. |
| 6 | Charge transport layer was completely removable. | Good. | Good. |
| 7 | Charge transport layer was completely removable. | Good. | Good. |
| Comparative Example: | | | |
| 1 | Charge transport layer is not removed. | Good. | Uneven image density and come-off of charge transport layer, due to non-uniform SD gap. |
| 2 | Removal of charge transport layer was incomplete to cause one-side scrape of intermediate layer. | Uneven image density due to non-uniform SD gap. | Uneven image density due to non-uniform SD gap. |
| 3 | Removal of charge transport layer was incomplete. | Uneven image density due to non-uniform SD gap. | Uneven image density due to non-uniform SD gap. |
| 4 | Removal of charge transport layer was incomplete. | Uneven image density due to non-uniform SD gap. | Uneven image density due to non-uniform SD gap. |
| 5 | Removal of charge transport layer was incomplete. | Uneven image density due to non-uniform SD gap. | Uneven image density due to non-uniform SD gap. |

As can be seen from Examples, the effect of the present invention can be obtained as long as the end portions of at least the thickest layer (here, the charge transport layer) are removed. The method employed in the present invention enables removal of the end portions of the charge transport layer without any ill effects on the underlying layer(s) of the charge transport layer.

Thus, according to the present invention, the process for producing an electrophotographic photosensitive member can be provided in which the end portion(s) of dried coating film(s) is/are removed by an efficient and inexpensive method.

According to the present invention, it is also possible to provide the electrophotographic photosensitive member produced by the the above process, and the process cartridge and the electrophotographic apparatus which have such electrophotographic photosensitive member.

What is claimed is:

1. A process for producing a cylindrical electrophotographic photosensitive member having a support and a photosensitive layer provided thereon; the process comprising:

a coating step of coating the surface of the support with a coating fluid to form a wet coating;

a drying step of drying the wet coating formed by the coating step, to form a dried coated film;

a cutting step of making a cut in the dried coated film formed by the drying step, in its peripheral direction; and a removal step of removing, by jetting a gas, the dried coated film on its end side extending from the cut made by the cutting step, wherein an angle α° formed between the direction of cutting and the surface of the dried coated film to be removed is 85° or more to less than 180°, and an angle β° formed between the direction of gas jetting and the surface of the dried coated film to be removed is 85° or more to less than 180°.

2. The process for producing a cylindrical electrophotographic photosensitive member according to claim 1, wherein said gas is air.

3. The process for producing a cylindrical electrophotographic photosensitive member according to claim 1, wherein an angle α° formed between the direction of cutting and the surface of the dried coated film to be removed, is 90° or more to less than 180°.

4. The process for producing a cylindrical electrophotographic photosensitive member according to claim 1, wherein an angle β° formed between the direction of gas jetting and the surface of the dried coated film to be removed, is 90° or more to less than 180°.

5. The process for producing a cylindrical electrophotographic photosensitive member according to claim 1, wherein an angle α° formed between the direction of cutting and the surface of the dried coated film to be removed and an angle β° formed between the direction of gas jetting and the surface of the dried coated film to be removed, satisfy the relationship of:

$$\alpha-10 \leqq \beta \leqq \alpha+80.$$

* * * * *